United States Patent [19]

Augur

[11] Patent Number: 4,811,858

[45] Date of Patent: Mar. 14, 1989

[54] COMBINATION SINGLE BOTTLE COOLER AND LIQUID CONTAINER

[76] Inventor: Thomas R. Augur, 6712 North Wayne, Gladstone, Mo. 64118

[21] Appl. No.: 149,401

[22] Filed: Jan. 28, 1988

[51] Int. Cl.[4] ..... A47J 41/00

[52] U.S. Cl. ..... 215/13.1; 220/4 B

[58] Field of Search ..... 220/4 B; 215/12 R, 13 R

[56] References Cited

U.S. PATENT DOCUMENTS

| | | | |
|---|---|---|---|
| 1,071,968 | 9/1913 | Steel | 215/13.1 |
| 1,463,027 | 7/1923 | Wile et al. | 215/13.1 |
| 1,625,183 | 4/1927 | Abbott | 215/13.1 |
| 2,072,630 | 3/1937 | Ferry | 215/12.1 |
| 2,419,291 | 4/1947 | Senter, Jr. | 215/12.1 |
| 3,308,980 | 3/1967 | Taylor | 215/13.1 |
| 3,779,298 | 12/1973 | Piccirelli et al. | 215/12.1 X |
| 4,006,835 | 2/1977 | Cummings | 215/12.1 |
| 4,228,908 | 10/1980 | Tweeton | 215/12.1 X |
| 4,549,410 | 10/1985 | Russell | 215/13.1 X |

FOREIGN PATENT DOCUMENTS

| | | | |
|---|---|---|---|
| 1482 | 5/1869 | United Kingdom | 215/13.1 |

*Primary Examiner*—William E. Tapolcai

*Attorney, Agent, or Firm*—Litman McMahon & Brown

[57] ABSTRACT

A combination single bottle cooler and liquid container includes a base portion, a shoulder portion, and a cap. The base and shoulder portions are sized and shaped to enclose a standard two liter soft drink bottle therein in cooperation with the cap and have a foam filled double walled construction. The cap includes an inner cap seal to seal an uncapped bottle in the container. The shoulder portion is sized and shaped such that the capped portion of the neck of a bottle within the container is accessible when the container cap is removed. A circumferential body seal is positioned between the base and shoulder portions, and a circumferential shoulder seal is positioned between the shoulder portion and cap such that the container is adapted to seal a fluid, not contained in a bottle, within the container.

12 Claims, 2 Drawing Sheets

COMBINATION SINGLE BOTTLE COOLER AND LIQUID CONTAINER

FIELD OF THE INVENTION

The present invention relates to portable insulated containers and, more particularly, to a combination two liter bottle cooler and liquid container.

BACKGROUND OF THE INVENTION

There are many portable devices available for cooling individual serving sized beverage containers, such as bottles and cans in the range of twelve to sixteen fluid ounces. Such devices are known by names including coolers, ice chests, drink boxes, and the like. Coolers of this type range in size form small sizes appropriate for a "six-pack" of cans and a small amount of ice to much larger sizes capable of cooling many six-packs or a varied combination of beverage containers and other foods.

In recent years beverage bottlers have made soft drinks available in two liter sized bottles formed of pliable plastic. Such bottles, while economical and convenient in many respects for bottlers, merchandisers, and consumers, pose some problems because of their size, shape, and weight. One particular inconvenience of a two liter bottle is that, while it contains somewhat less than a six pack of twelve ounce cans, the shape of a two liter bottle is such that it does not fit in a six pack sized cooler. Consequently, a consumer wishing to take approximately a two liter or six pack amount of a soft drink on a picnic, sporting event, or the like must place a two liter bottle in a relatively large ice chest, drink a lukewarm soft drink from an uncooled two liter bottle, or buy a six pack and place it in a conveniently sized six pack type cooler.

SUMMARY OF THE INVENTION

The present invention provides an additional option for conveniently carrying and cooling two liter amounts of beverages in the form of a container specially sized and shaped to contain a relatively standard sized two liter soft drink bottle. The container according to the present invention generally includes a base portion, a shoulder portion, and a cap. The base and shoulder portions are sized and shaped to receive a relatively standard configuration two liter bottle therein and include cooperating threads for attachment of the shoulder portion to the base portion. The base and shoulder portions are formed of thermal insulator material and preferably each has a double wall construction filled with an insulator such as expanded foam plastic. The base portion preferably has a handle or shoulder strap, which may be adjustable in length, for convenient carrying of the container.

The cap is also formed of a thermal insulator material such as a plastic. The cap includes an inner seal for engagement with the mouth of a bottle such that the bottle can be sealed either by a bottle cap or by the container cap. The shoulder portion is shaped such that the capped portion of the neck of the two liter bottle is exposed and accessible when the container cap is removed such that the bottle cap can be conveniently removed and replaced with the container cap remove. The container cap and shoulder portion have cooperating threads for attachment of the cap to the shoulder portion.

The container of the present invention is also adapted for carrying liquids not contained in a bottle. For this purpose, a circumferential body seal is positioned in the joint between the base and shoulder portions; and a circumferential shoulder seal is positioned between the shoulder portion and the container cap. When the base and shoulder portions are securely threaded together and the cap securely threaded into the shoulder portion, the container is fluid tight. The container may be used for maintaining the temperature of either cold or hot beverages.

OBJECTS OF THE INVENTION

The principal objects of the present invention are: to provide an insulative container for a single, relatively large bottle; to provide such a container which is particularly adapted for carrying a standard two liter soft drink type bottle; to provide such a container including a base portion, a shoulder portion threadable onto the base portion, and a cap threadable into the shoulder portion to thereby enclose a two liter bottle therein; to provide a such a container including handle or adjustable shoulder strap pivotally attached to the base portion for convenient handling of the container; to provide such a container wherein the base and shoulder portions preferably have a double walled construction with a foam plastic insulator filling the space between the double walls; to provide such a container wherein the shoulder portion is sized and shaped such that the capped portion of the neck of a two liter bottle extends from the container when the container cap is removed to provide convenient access to the bottle cap for removal and replacement; to provide such a container including a cap seal within the container cap to seal an uncapped two liter bottle within the container; to provide such a container which is adapted to seal fluids within the container which are not contained within a bottle; to provide such a container including a circumferential body seal between the base and shoulder portions and a circumferential shoulder seal between the cap and shoulder portions to seal a fluid within the container when the body and shoulder portions are securely threaded together and the cap is securely threaded into the shoulder portion; and to provide such a combination single bottle cooler and liquid container which is economical to manufacture, convenient and thermally efficient in use, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
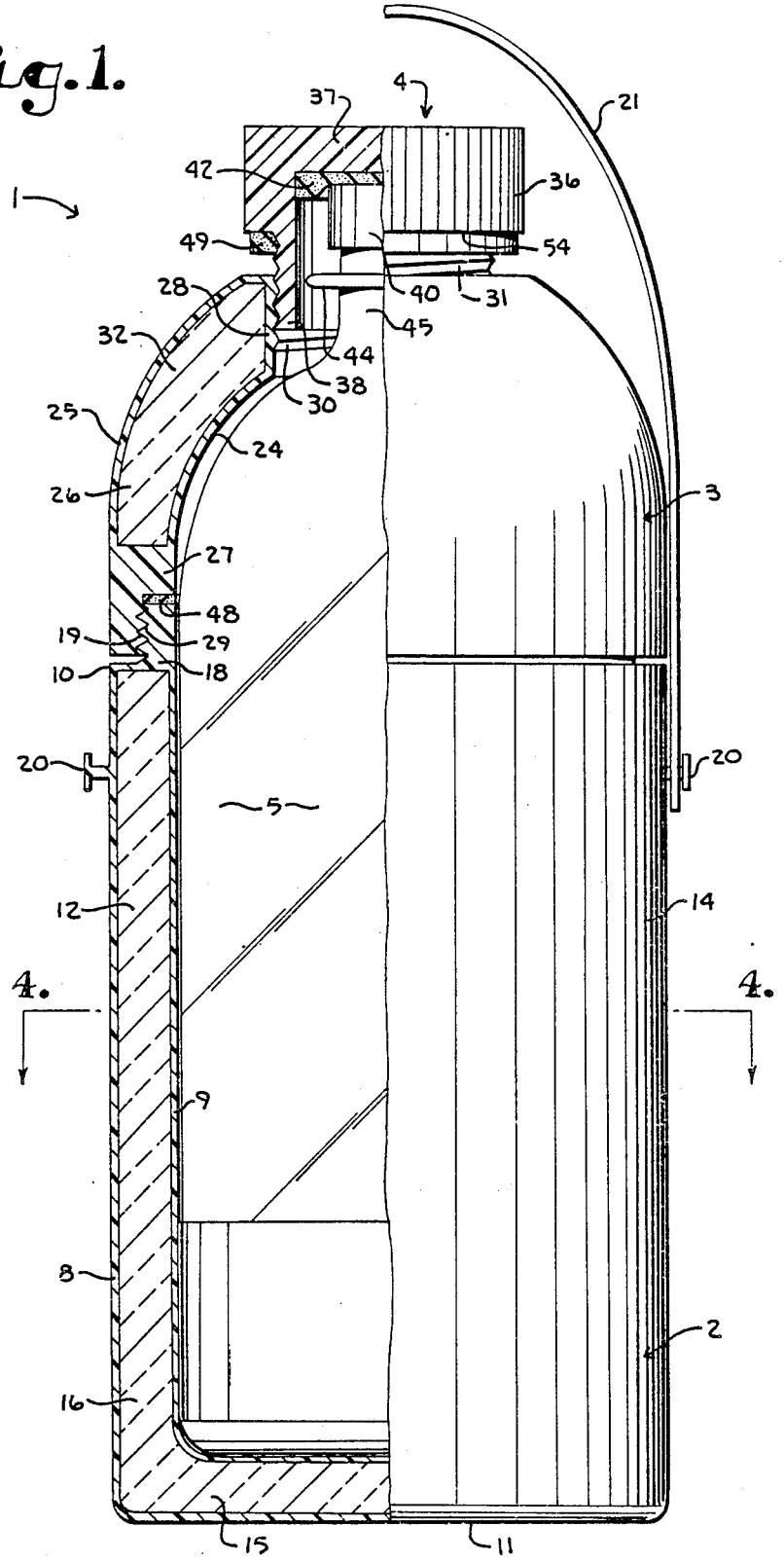
FIG. 1 is a side elevational view, partially in section, illustrating a combination single bottle cooler and liquid container according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as basis for the claims and as a representative basis for teaching one skilled in the art to variously employ the present invention in virtually any appropriately detailed structure.

Referring to the drawings in more detail:

The reference numeral 1 generally designates a combination single bottle cooler and liquid container according to the present invention. Generally, the cooler or insulated container 1 includes a base portion 2, a shoulder portion 3 removably attached to the base portion 2, and a cap 4 removably attached to the shoulder portion 3. The base portion 2, the shoulder portion 3, and the cap 4 are assembled to enclose a bottle 5 within the container 1 and are all formed of thermal insulation material to insulate the contents of the bottle 5. Preferably, the components of the container 1 are sized and shaped to enclose and insulate a substantially standard sized two liter soft drink bottle 5.

The illustrated base portion 2 is formed of an outer base shell 8 and an inner base shell 9 received within the outer shell 8 and attached thereto at an upper end 10 of the base portion. The shells 8 and 9 are cylindrical in shape and are closed at a lower end 11 of the base portion 2. The inner and outer shells 8 and 9 are sized to form a base insulation space 12 therebetween in the walls 14 and floor 15 of the base portion 2. The insulation space 12 may be evacuated or contain air sealed therein for insulation purposes. In such a case, additional connection webs (not shown) would be formed between the outer and inner shells 8 and 9 within the floor 15 of the base portion 2 for enhanced rigidity of the base portion 2. In the preferred embodiment, the insulation space 12 is filled with a base insulation material 16, such as a foam plastic or the like.

At the upper end 10 of the base portion 2, an upstanding annular projection 18 connects the outer and inner base shells 8 and 9. The projection 18 has external base threads 19 formed thereon for removable attachment of the shoulder portion 3 to the base portion 2. The base portion 2 preferably has buttons or pivot members 20 for the pivotal attachment of a shoulder strap or handle 21 to the container 1 for carrying the container 1. If a shoulder strap is employed, it may be adjustable in length. The base shells 8 and 9 and the projection 18 are preferably formed of a material such as a plastic which has thermal insulating properties and which is resistant to damage from impact. The base portion 2 may be integrally formed by known processes and the insulation space 12 subsequently filled with the insulation material 16.

The shoulder portion 3 of the container 1 has a double wall construction similar to the base portion 2 and is formed of similar materials. An inner shoulder shell 24 is positioned within an outer shoulder shell 25 and in spaced relation thereto to form a shoulder insulation space 26. The lower ends of the shells 24 and 25 are connected by a depending shoulder annular projection 27. The shells 24 and 25 curve inwardly toward their top ends and are connected at their top ends by a cylindrical cap receptacle wall 28. The shoulder annular projection 27 is internally threaded with lower shoulder threads 29 which cooperate with the base threads 19 to attach the shoulder portion 3 to the base portion 2. The cap receptacle wall 28 is internally threaded with upper shoulder threads 30 which cooperate with cap threads 31 on the cap 4 to attach the cap 4 to the shoulder portion 3. Similar to the base portion 2, the shoulder insulation space 26 may be evacuated or have air sealed therein for insulation purposes. Preferably, the shoulder insulation space 26 is filled with a shoulder insulation material 32, such as a foam plastic.

Figure 2:
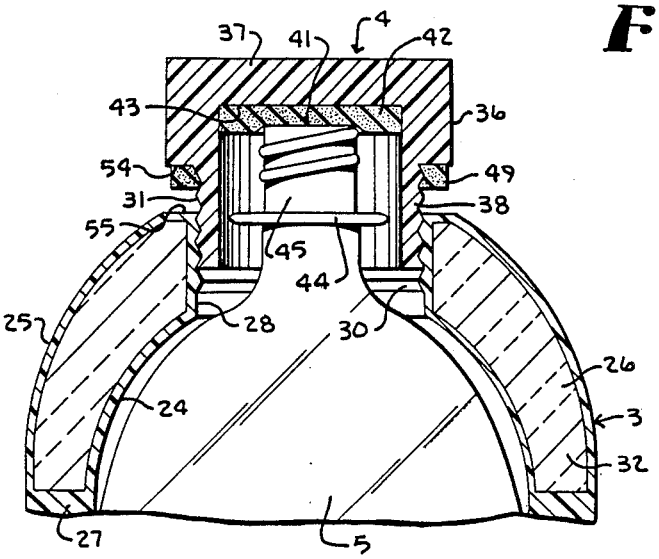
FIG. 2 is a fragmentary sectional view of the cooler and illustrates an inner cap seal to seal an uncapped bottle positioned in the cooler.

The cap 4 is generally cylindrical and includes a gripping portion 36 including an upper cap wall 37 and a depending attachment wall 38. The external surface of the gripping portion 36 is preferably scored or otherwise roughened to facilitate gripping of the cap 4 for tightening or loosening the cap. The attachment wall 38 has the cap threads 31 formed externally thereon for cooperation with the upper shoulder threads 30. The cap 4 is adapted for use with a bottle 5 having a bottle cap 40 thereon (FIG. 1) or with an uncapped bottle 5 (FIG. 2). Particularly for sealing the mouth 41 of an uncapped bottle 5, the cap 4 is provided with a resilient cap fluid seal 42. The cap seal 42 is positioned against a lower surface 43 of the cap upper wall 37.

When the cap 4 is threaded into the shoulder portion 3 with an uncapped bottle 5 in the container 1, engagement between the cap seal 42 and the mouth 41 of the bottle 5 seals the contents of the bottle 5 therein. When replacing the cap 4 with a capped bottle 5 positioned in the container 1, the cap 4 is turned until the cap seal 42 engages the top of the bottle cap 40. The cap 4 and cap receptacle wall 28 are of sufficient diameter to accomodate a bottle 5 having a grip disc 44 on the neck 45 thereof. The cap 4 itself is formed of a thermal insulating plastic similar to the shells of the base and shoulder portions 2 and 3. The cap seal 42 is preferably formed of a closed cell foam rubber or resilient foam plastic.

Figure 3:
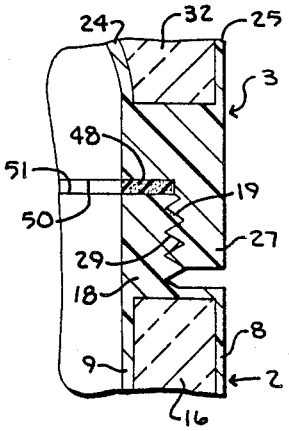
FIG. 3 is an enlarged sectional view of a junction between base and shoulder portions of the cooler and illustrates a base fluid seal therebetween.

The container 1 is adapted for use as a liquid container to carry unbottled liquids. For this purpose, the container 1 is provided with a body fluid seal 48 positioned between the base portion 2 and the shoulder portion 3 and a shoulder fluid seal 49 positioned between the shoulder portion 3 and the cap 4. Referring to FIGS. 1 and 3, the body seal 48 is a flat ring positioned in a counter bore of the shoulder projection 27 against a lower annular shoulder seal surface 50. When the shoulder portion 3 is threaded onto the base portion 2 and tightened, the body seal 48 is compressively engaged between the shoulder surface 50 and an annular base seal surface 51 of the base annular projection 18 to seal between the base portion 2 and the shoulder portion 3. The body seal 48 may be formed of a material similar to the cap seal 42.

Figure 5:
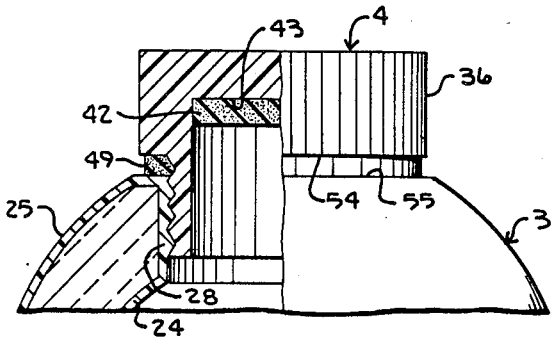
FIG. 5 is a fragmentary sectional view, partially in section, and illustrates engagement of a shoulder fluid seal between the cap and the shoulder portion of the cooler.
Figure 4:
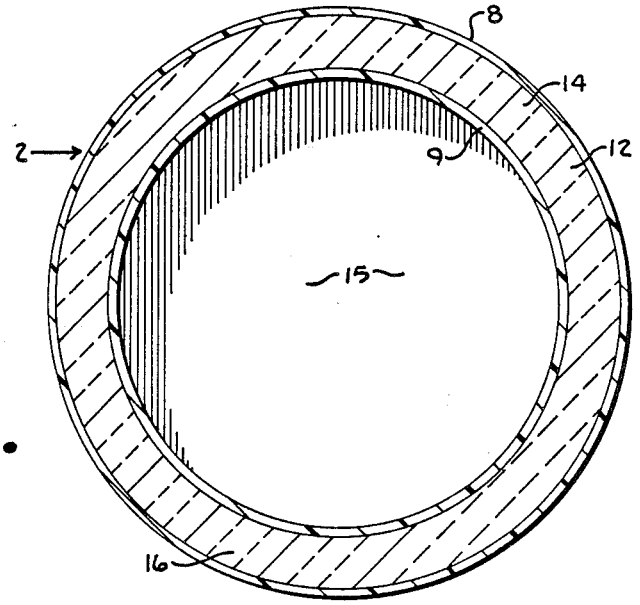
FIG. 4 is a transverse sectional view taken on line 4.—4. of FIG. 1 at a somewhat reduced scale and illustrates insulation details of the base portion of the cooler.

Referring to FIGS. 1, 2, and 5, the shoulder fluid seal 49 is of a flat annular shape and is positioned against an annular cap seal surface 54 of the cap 4. When the cap 4 is tightened, the shoulder seal 49 is compressed between the cap seal surface 54 and an upper annular shoulder seal surface 55. The attachment wall 38 of the cap 4 is of sufficient length and the threads 30 and 31 have sufficient range that the cap 4 can engage capped bottles 5, can seal uncapped bottles, or can seal unbottled liquids within the container 1.

Referring to FIGS. 1 and 2, the shoulder portion 3 is sized and shaped in such a manner that when the cap 4 is removed, the neck 45, bottle cap 40, and mouth 41 of a bottle 5 within the container 1 are accessible. These provisions facilitate gripping the bottle cap 40 for uncapping or capping the bottle 5 without removal of the shoulder portion 3. Additionally, pouring into glasses via the mouth 41 is facilitated by the extension of the bottle neck 45 past the upper shoulder surface 55.

In use, the components of the container 1 are preferably acclimated to the desired temperature of the bottle contents prior to use of the container 1. For use of the container 1 with cold beverages, the base portion 2, shoulder portion 3, and cap 4 are simply placed in a refrigerator or freezer for a period of time prior to use to pre-cool the components of the container 1. It is also desirable to pre-cool the beverage filled bottle 5 prior to use to maximize the length of time that the liquid will remain cool.

The bottle 5 is packed in the container 1 by placement in the base portion 2, threading the shoulder porting 3 onto the base portion, then threading the cap 4 into the shoulder portion 3. To facilitate handling of the base and shoulder portions 2 and 3 during assembly and disassembly, the outer surfaces of the outer shells 8 and 25 are preferably roughened, scored, or provided with some other type of grip enhancing treatment. For use with heated liquids such as coffee, tea, soup, or the like, the insulated container 1 is preferably filled with hot water prior to filling with the desired liquid to preheat the container 1.

The container 1 is particularly adapted to accommodate a bottle 5 which is a standard two liter soft drink type of bottle. However, with modifications to the size and shape of its components, the container 1 could be adapted for other standard sized bottles, such as one liter soft drink bottles, classic sized wine and champagne bottles, and the like. Therefore, such modifications to the size and shape of the container 1 are foreseen as functional equivalents of the preferred embodiment of the container 1 as described and illustrated, except as specifically claimed otherwise.

It is to be understood that while certain forms of the present invention have been illustrated and described herein, it is not to be limited to the specific forms or arrangement of parts described and shown.

What is claimed and desired to be secured by Letters Patent is as follows:

1. A bottle insulator structure comprising:
(a) a base portion formed of thermal insulating material;
(b) a shoulder portion formed of thermal insulating material;
(c) said shoulder portion removably attached to said base portion to enclose a bottle within said base portion and said shoulder portion;
(d) a cap formed of thermal insulating material and removably attached to said shoulder portion to entirely close said structure;
(e) a body fluid seal positioned between said base portion and said shoulder portion and a shoulder fluid seal positioned between said shoulder portion and said cap such that said structure when assembled is fluid tight to retain a fluid within said structure; and
(f) a resilient cap fluid seal positioned within said cap and engageable with an uncapped bottle enclosed within said structure to thereby seal a fluid within said uncapped bottle.

2. A structure as set forth in claim 1 including:
(a) a handle attached to said base portion.

3. A structure as set forth in claim 1 wherein said base portion includes:
(a) an outer base shell;
(b) an inner base shell positioned within said outer base shell and attached thereto to form a base insulation space between said outer base shell and said inner base shell; and
(c) a base thermal insulation material filling said base insulation space.

4. A structure as set forth in claim 1 wherein said shoulder portion includes:
(a) an outer shoulder shell;
(b) an inner shoulder shell positioned within said outer shoulder shell and attached thereto to form a shoulder insulation space between said outer shoulder shell and said inner shoulder shell; and
(c) a shoulder thermal insulation material filling said shoulder insulation space.

5. A structure as set forth in claim 1 including:
(a) cooperating body threads formed on said base portion and said shoulder portion whereby said shoulder portion is threadedly attached to said base portion.

6. A structure as set forth in claim 1 including:
(a) cooperating cap threads formed on said cap and said shoulder portion whereby said cap is threadedly attached to said shoulder portion.

7. A structure as set forth in claim 1 wherein:
(a) said shoulder portion and said cap are sized and shaped such that a bottle cap of a capped bottle enclosed within said structure is accessible when said cap of said structure is removed.

8. A structure as set forth in claim 1 wherein:
(a) said base portion, said shoulder portion, and said cap are sized and shaped to enclose a substantially standard two liter soft drink bottle within said structure.

9. A structure as set forth in claim 1 wherein:
(a) said base portion includes:
(1) an outer base shell;
(2) an inner base shell positioned within said outer base shell and attached thereto to form a base insulation space between said outer base shell and said inner base shell; and
(3) a base insulation material filling said base insulation space; and
(b) said shoulder portion includes:
(1) an outer shoulder shell;
(2) an inner shoulder shell positioned within said outer shoulder shell and attached thereto to form a shoulder insulation space between said outer shoulder shell and said inner shoulder shell; and
(3) a shoulder thermal insulation material filling said shoulder insulation space.

10. A two liter bottle insulator structure comprising:
(a) a base portion including:
(1) an outer base shell;
(2) an inner base shell positioned within said outer base shell and attached thereto to form a base insulation space between said outer base shell and said inner base shell; and (3) a base insulation material filling said base insulation space;

(b) a shoulder portion including:

(1) an outer shoulder shell;

(2) an inner shoulder shell positioned within said outer shoulder shell and attached thereto to form a shoulder insulation space between said outer shoulder shell and said inner shoulder shell; and (3) a shoulder thermal insulation material filling said shoulder insulation space;

(c) said shoulder portion threadedly attached to said base portion to enclose a bottle within said base portion and said shoulder portion;

(d) a cap formed of thermal insulating material and threadedly attached to said shoulder portion to entirely close said structure;

(e) a body fluid seal positioned between said base portion and said shoulder portion and a shoulder fluid seal positioned between said shoulder portion and said cap such that said structure when assembled is fluid tight to retain a fluid within said structure;

(f) a resilient cap fluid seal positioned within said cap and engageable with an uncapped bottle enclosed within said structure to thereby seal a fluid within said uncapped bottle; and (g) said base portion, said shoulder portion, and said cap are sized and shaped to enclose a substantially standard two liter soft drink bottle within said structure.

11. A structure as set forth in claim 10 including:

(a) a handle attached to said base portion.

12. A structure as set forth in claim 10 wherein:

(a) said shoulder portion and said cap are sized and shaped such that a bottle cap of a capped bottle enclosed within said structure is accessible when said cap of said structure is removed.

* * * * *